US006234881B1

(12) United States Patent
Martin, Jr.

(10) Patent No.: US 6,234,881 B1
(45) Date of Patent: May 22, 2001

(54) GRINDING MACHINE FOR FORMING CHIP-PRODUCING CUTTING TOOLS

(75) Inventor: Richard L. Martin, Jr., Fredericksburg, VA (US)

(73) Assignee: Walter AG, Tübingen (DE)

( * ) Notice: Subject to any disclaimer, the term of this patent is extended or adjusted under 35 U.S.C. 154(b) by 0 days.

(21) Appl. No.: 09/131,013

(22) Filed: Aug. 6, 1998

(51) Int. Cl.[7] ..... B24B 9/00

(52) U.S. Cl. ..... 451/205; 451/204; 451/206; 451/48

(58) Field of Search ..... 451/48, 160, 204, 451/205, 226

(56) References Cited

U.S. PATENT DOCUMENTS

| | | | | |
|---|---|---|---|---|
| 3,646,593 | * | 2/1972 | Schubert | 51/165 R |
| 4,461,121 | * | 7/1984 | Motzer et al. | 51/3 |
| 4,817,338 | * | 4/1989 | Zang | 51/48 |
| 4,843,765 | * | 7/1989 | Panetti | 51/178 |
| 4,878,318 | * | 11/1989 | Panetti | 51/178 |
| 5,156,071 | * | 10/1992 | Stevens | 76/37 |
| 5,514,025 | * | 5/1996 | Hasegawa et al. | 451/44 |
| 5,562,525 | * | 10/1996 | Mori et al. | 451/5 |
| 5,630,747 | * | 5/1997 | Haller | 451/11 |
| 5,895,311 | * | 4/1999 | Shoitani et al. | 451/5 |

* cited by examiner

*Primary Examiner*—Allen Ostrager
*Assistant Examiner*—William Hong
(74) *Attorney, Agent, or Firm*—Frishauf, Holtz, Goodman, Langer & Chick, P.C.

(57) ABSTRACT

Cylindrical surface regions (1) of cutting tools (2, 21), such as drills, boring tools, reamers or the like, that is, cutting tools formed with chip removal grooves or flutes or recesses (6), are ground by engaging a rotary cutting disk (3) against the ribs (5) between the chip removal grooves. The cutting tool (2, 21), during the grinding operation, is rocked or oscillated to-and-fro (24) about its longitudinal axis (18) in such a manner that the cutting disk (3) covers the cylindrical surface portion in circumferential direction at least several times. The cutting disk (3) also may rock or oscillate about an axis perpendicular to the axis (7) of rotation of the cutting disk (3). Suitable frequencies are between about 0.1 Hz and 1 Hz, preferably 0.5 Hz, for the rocking movement of the cutting tool (2, 21), with the oscillatory movement of the grinding disk being higher than that of the cutting tool, and for example between 1 Hz and 10 Hz. After grinding a circumferential surface region, the cutting tool can be indexed rapidly to the next surface region to be ground, so that time loss due to the grinding disk passing over a groove or flute (5) is a minimum, and vibration and shock imparted to the cutting tool are effectively eliminated.

7 Claims, 2 Drawing Sheets

GRINDING MACHINE FOR FORMING CHIP-PRODUCING CUTTING TOOLS

FIELD OF THE INVENTION

The present invention relates to a method, and to a machine to carry out the method, to grind cylindrical surface regions of cutting tools, typically drills, boring tools, reamers, or the like, and especially such tools which have comparatively large recesses, forming flutes or grooves, e.g. to remove cutting chips.

BACKGROUND

It is frequently necessary to grind surfaces and surface regions of cutting tools to precisely predetermined dimensions. This is especially so for stepped tools of all kinds, for example drilling tools, drills with stepped diameters, reamers, milling tools in general, end mills, circumferential mills, roll-over milling tools, and the like.

Briefly, the tools for which the present invention is especially applicable are stepped tools with straight, spiral or angular grooves or flutes, step drills with straight spiral or angular flutes and made of high-speed steel, carbide, or with brazed cutting edges; reamers and step reamers with straight, spiral or angular flutes; end mills having cylindrical and/or conical chip removal grooves of various shapes; milling cutters in general, and especially side milling cutters, hobbing tools. All the tools are made of high-speed steel, carbide, ceramic, or other materials used in cutting tools, or may have brazed-on cutting inserts. The surface quality of the surfaces of such tools should be as good as possible and the dimensions of the tools should be highly accurate.

In the specification that follows, the term "cutting tools" will be used generically for any and all of the above tools for which the present invention is especially applicable.

Grinding processes are used for manufacturing cutting tools, as well as to sharpen cutting tools which have been used. For grinding, a grinding element, for example a grinding disk (also known as a grinding wheel), is engaged with the respective cutting tool. A not insignificant engagement pressure is exerted by the grinding element on the cutting tool. Generally, the engagement pressure acts more or less perpendicularly to the outer circumference of the cutting tool. The cutting tool can be rotated about its longitudinal axis, so that the grinding element covers the entire circumference of the cutting tool. In this axial rotation, the cutting tool is engaged only intermittently by the grinding element due to the presence of the chip removal flutes or grooves, or by other recesses which may be formed in the cutting tool. When the grinding element is facing such a flute, groove or recess, it runs freely. When the cutting tools have relatively large flutes or recesses, the grinding tool is in engagement with the cutting tool only for a fraction of the overall time during which the grinding operation takes place. The non-grinding time is used up by the grinding element running free, for example when it is opposite a chip removal flute located between the cutting surfaces or cutting surface portions of the cutting tool which are actually to be ground.

Comparatively long cutting tools, such as drills, boring tools, reamers, and the like, have slight lateral, that is, radial resilience or elasticity which may lead to problems with regard to accuracy of the grinding. If the cutting tool deflects only slightly when the grinding element, typically a grinding disk, is in engagement with the surface region to be cut, the surface which will be ground will no longer be precisely cylindrical but, rather, slightly bulged or eccentric or barrel-shaped, or otherwise deviates from an ideal design shape and size. Precision tools have diameter tolerances in the region of 1 $\mu$ meter. Such deflections, thus, may lead to quality problems.

THE INVENTION

It is an object of the present invention to provide a method for grinding cylindrical surfaces of cutting tools which ensures high quality and accuracy of the surface to be ground.

Briefly, a grinding element, such as a grinding disk, carrying out a grinding movement, typically being driven and rotated about its axis, is applied against the surface region of the cutting tool which is to be ground to cylindrical shape and, while so engaged, the cutting tool is rocked or oscillated or pivoted to-and-fro about its longitudinal axis. This longitudinal axis defines a cylindrical cutting surface which is to be produced. Rocking or oscillating the cutting tool about its axis during the grinding operation results in a cylindrical ground surface.

The cutting tool, thus, is not continuously rotated about its longitudinal axis but, rather, is rocked back-and-forth about the axis in a predetermined range, that is, essentially in the range in which the grinding element engages the surface region to be ground. This avoids loss of engagement of the grinding element with the cutting tool when the grinding element is over the regions in which the outer surface of the cutting tool is formed with recesses, for example chip removal grooves or flutes. The grinding process is carried out with engagement of a surface region of the cutting tool so that the grinding element is preferably in continuous engagement with the surface of the cutting tool. This is particularly true for cutting tools having spiral grooves, such as drills.

The method of the invention results in several advantages: The engagement pressure between the grinding element and the cutting tool, effective upon cutting, is continuously present. Alternating deflection of the cutting tool towards and away from the grinding tool is eliminated. This substantially increases the accuracy of the grinding operation. In prior art grinding, the cutting tool is continuously rotated when carrying out a cylindrical grinding process; thus the respective flutes adjacent the cylindrical surfaces are passed again and again by the grinding disk, requiring operating time. In accordance with the method of the present invention, however, a free space resulting in a run or empty run must be covered, ideally only once, and at most only a few times and high-speed indexing can be used. The overall operating time for grinding thus can be reduced, while achieving higher accuracy and precision in the tool on which the operation is carried out.

The rocking or oscillating movement is comparatively slow, and results in continuous engagement between the grinding element and the cutting tool. Since the engagement is continuous, no vibration will result which otherwise occurs if an interrupted cylindrical surface is rotatably carried in engagement with a grinding element, typically a grinding disk. Eliminating vibration results in a substantially improved surface quality on the cutting tool.

Wear, or consumption, of the grinding disk material is reduced via the invention, as compared to the previous traditional method. This is due to the many interrupted engagements which occur at high speed in the traditional method whereas the invention has significantly fewer interrupted engagements, each of which is made at a relatively low speed. Thus, the benefit is lower disk consumption (cost savings) and better tool accuracy.

In general principle, it is possible to use the method of the invention also on cylinders which have a continuous circumferential surface. It is, however, particularly suitable—as above set forth—for surface regions of cutting tools which extend only over a portion of the circumference of the cutting tool itself, being interrupted by flutes or grooves. The oscillating or rocking movement of the cutting tool can be so dimensioned that the grinding element and the cutting tool to be ground come out of engagement only for short periods of time. This may occur especially in tools which have straight grooves or flutes. The short-time separation between grinding element and cutting tool is not critical when the oscillating movement is relatively slow, so that a very short-time interruption of engagement pressure, which otherwise occurs between the cutting tool and the grinding element, does not result in impact or cause vibrations. The loss of operating time as a flute is passed is substantially less than upon continuous rotation of the cutting tool. It is considered advantageous to so dimension the oscillatory or rocking movement that the entire surface region is covered by the grinding element without the cutting tool and grinding element being entirely out of engagement.

The amplitude of the oscillatory or rocking movement may be smaller amplitude when the entire surface region is gradually covered upon the oscillation or rocking of the cutting tool.

The rocking movement can be a regular periodic oscillatory movement which, with respect to time, for example is in form of a sine oscillation. Preferably, a triangular course—with respect to time—of the oscillation is used. This has the additional advantage of a constant relative speed between the grinding element and the cutting tool. Thus, the material removal at different locations of the surface region is constant and uniform. If necessary, other forms of oscillatory behavior—with respect to time—are possible. In space, the oscillation movement may be on a straight path, back-and-forth, or in a curved path, back-and-forth or, for example, on a curved path which may be O-shaped or 8-shaped.

The grinding operation itself can be carried out sequentially on various surface regions of the cutting tool. In accordance with a first embodiment, it is possible to continue the grinding process until the respective surface region is appropriately ground and cut. It is possible, however, to interrupt the grinding process before the entire cut is carried out, and then continue it on a different surface region, returning to the first surface region at a later time, for example with a fine or finish-cut grinding element. Which variation is to be selected depends on specific materials and characteristics of the cutting tool to be ground.

Various cutting elements are suitable. A cutting disk is preferred, having a plane or flat side which is coated at least with a strip of abrasive material. Such abrasive material may be diamonds or cubic boron nitrite (CBN), or other abrasives used in the grinding of cutting tools. Such grinding disks are very stiff and permit high grinding speeds. The method in accordance with the present invention permits working on cylindrical surfaces while preventing lateral deflection of the cutting tool to be ground, which deflections might result in slightly bulging or eccentric-shaped surface portions.

In accordance with another embodiment of the present invention, an oscillatory movement is superimposed on the rotation of the grinding disk. This permits particularly high surface qualities on the cutting tool. If a flat side of a grinding disk is used as the grinding surface, the oscillation of the grinding disk preferably extends in a direction which corresponds to the circumferential direction of the cylindrical surface to be ground. If necessary, and particularly in tools which have straight flutes, the oscillatory movement can also be in axial direction—with respect to the axis of the cutting tool. The oscillatory pivoting or rocking movement of the cutting tool, and the oscillatory movement of the cutting disks, then extend in directions which are angled with respect to each other, preferably a right angle.

Preferably, different oscillation speeds are used for the oscillatory movement of the cutting tool and of the grinding element, if both are oscillating or rocking. It has been found suitable to operate the cutting tool at a relatively low oscillatory frequency, for example about 0.5 Hz, back-and-forth whereas the grinding disk oscillates with a comparatively higher frequency, for example between about 1 Hz and 10 Hz. These oscillations, either one or all, may be in form of sine oscillations, triangular oscillations, trapeze-shaped oscillations, or similar—with respect to time. The frequency of rocking or oscillation of the cutting tool can be between, for example, about 0.1 Hz and 1 Hz; preferably, however, it is at about 0.5 Hz.

The method in accordance with the present invention is particularly suitable when used subsequently to coarse working steps to obtain finely ground, high-quality ground surfaces on the cutting tool. In a coarse working step, rocking or oscillating the cutting tool back-and-forth is not necessary. It is sufficient if the respective cylindrical surface of the cutting tool is subjected to a slow rotary movement. The gaps between the cutting tool, that is, when the grinding disk is opposite a groove, can be passed at a faster rotary speed than when the grinding element is in engagement with the cutting tool, that is, the cutting tool can be rotated quickly when the region of a groove or the like is reached.

In accordance with a feature of the invention, the machine to carry out the method described has a holder, for example a chuck for the cutting tool, which retains the cutting tool with its longitudinal central axis in predetermined position. This machine must permit the cutting tool to be rocked or oscillated back and forth about this longitudinal axis. The grinding machine, additionally, has a grinding head on which a grinding disk is suitably journaled for rotation about the disk axis. The grinding head is retained by a carrier which can be moved towards the cutting tool. A suitable arrangement, well known, is provided to rock the rotating cutting disks back-and-forth. These arrangements can be provided directly on the cutting head or on the carrier for the cutting head. They are so arranged that the cutting disk can be oscillated in a predetermined direction, or in a direction which can be adjusted and set on the machine, while the cutting disk is rotated. Preferably, these adjustment arrangements can be controlled with respect to amplitude and frequency of oscillation, for example from a central control unit.

DRAWINGS

DETAILED DESCRIPTION

Figure 1:
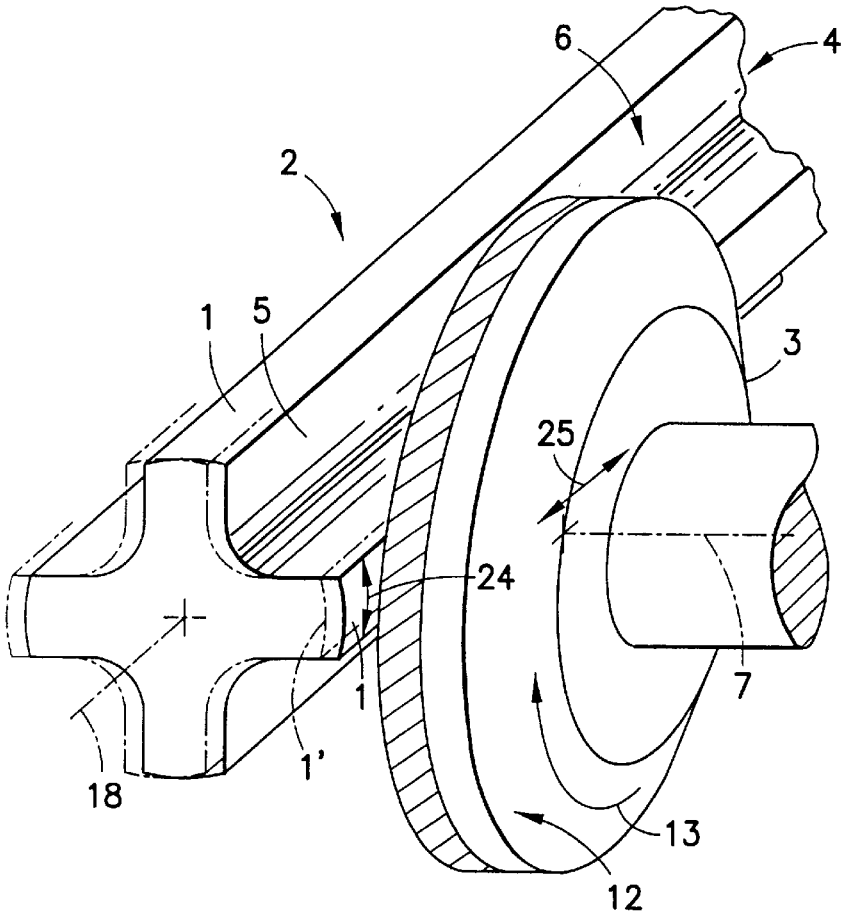
FIG. 1 is a highly schematic perspective view of a cutting tool and a grinding disk in engagement therewith.

Grinding of outer partially cylindrical surfaces 1 of a cutting tool 2 by a grinding disk 3 is highly schematically illustrated in FIG. 1. The cutting tool 2 has a tool body 4 with radially projecting longitudinal ribs 5 (also known as teeth). Grooves or flutes, forming recesses 6, are located between the ribs 5. The ribs extend up to the outer circumference of surface 1. All outer surfaces 1 are on the circumference of a theoretical cylinder.

Figure 6:
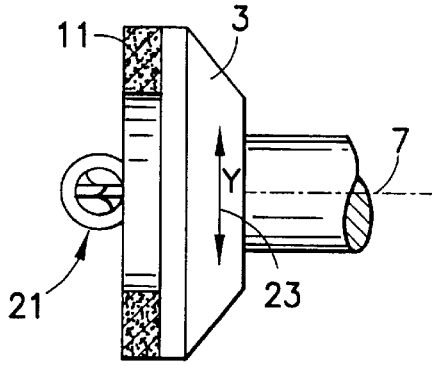
FIG. 6 is a highly schematic fragmentary front view of the drill of FIGS. 3–5 and using an oscillating grinding disk, illustrating a fine grinding step.
Figure 7:
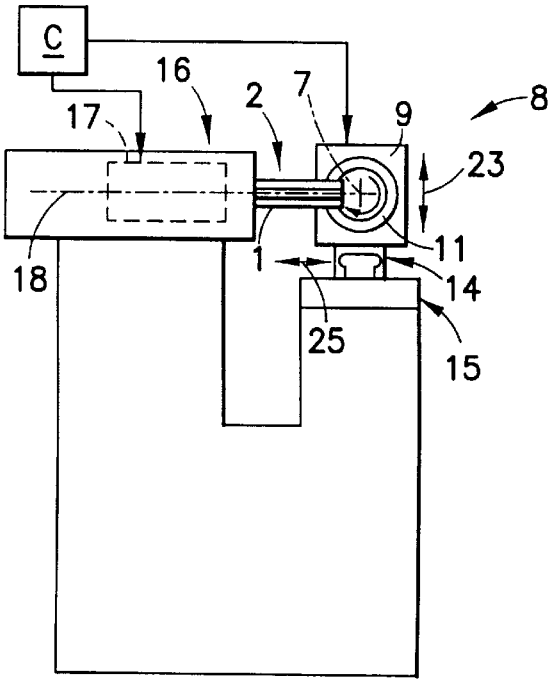
FIG. 7 is a highly schematic side view of a grinding machine, omitting all elements not necessary for an understanding of the present invention.

The outer circumferential surfaces 1 are fine-ground by the grinding disk 3. The grinding disk 3 is rotated in direction 13 about its axis 7. The grinding disk 3 is held in a grinding machine 8—see FIG. 7—on a grinding head 9. The grinding disk 3 has a flat or plane side which is covered with an abrasive coating 11 (FIGS. 4–7). The abrasive coating 11 may be applied, for example, in form of a ring-shaped strip. This coating can be formed by diamond grains, diamond powder, or cubic boron nitrite (CBN), or by any other suitable grinding material. It is secured on a relatively stiff base body 12 (FIG. 1), which is sufficiently sturdy and resistant so that it is not subject to perceptible deformation even upon application of stronger forces F (FIG. 2) between the grinding disk 3 and the cutting tool 2. The grinding head 9 can be moved up-and-down, as schematically shown in FIG. 7 by arrow 23, that is, in a direction perpendicular to its axis of rotation 7, as well as perpendicular to the central axis 18 of the cutting tool 2. Suitable drive and guide elements to carry out this movement in the direction of arrow 23 have been omitted since they are well known in the art, and any appropriate construction is suitable.

The grinding head 9 can be engaged against the cutting tool 2, or moved away therefrom, by a suitable guide structure 14. A further guide structure 15 permits movement of the cutting head 9 in axial direction of the cutting tool 18, that is, towards the right and left in FIG. 7. The guides 14, 15 can have regular, 90° adjustment axes. In accordance with a feature of the invention, the guide and adjustment system in the directions shown by arrows 23 and 25, however, not only permits long-path shifting or feeding but, in addition, fast oscillatory movement at a frequency of between about 1 Hz and 10 Hz, with stroke lengths of from a few millimeters to several millimeters, that is, up-and-down, right-left in FIG. 7.

The grinding machine 8 additionally has a tool holder 16, for example a chucking arrangement, which holds the cutting tool 2. The tool holder 16 thus has a suitable reception and clamping arrangement for the cutting tool 2, which is to be ground on the grinding machine 8. The reception and clamping arrangement is coupled to a positioning system 17. The system 17 permits controlled positioning of the cutting tool 2 about its longitudinal axis 18. This axis 18, at the same time, defines the curvature of the cylindrical surface 1, and forms the center of the radius of the cylinder defining the cylindrical surface. The adjustment and positioning system 17 is so constructed that it preferably can be controlled by a central control unit C which controls first engagement movement of the cutting tool 2 and then predetermined rotary or pivotable positioning of the cutting tool 2. In addition, the system 17 can control oscillatory or rocking movement of the cutting tool 2 about its longitudinal axis 18 in any specific rotated or pivoted position thereof. The frequency of oscillation or rocking, for example, is about 0.5 Hz.

Figure 3:
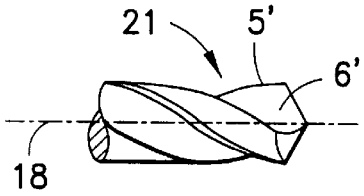
FIG. 3 illustrates a cutting tool in form of a drill to be ground, in a fragmentary top view.

FIG. 3 illustrates grinding of a cutting tool 2, and particularly part-cylindrical outer surfaces, in which the cutting tool is a drill 21, which is to be ground to form a stepped drill.

Figure 4:
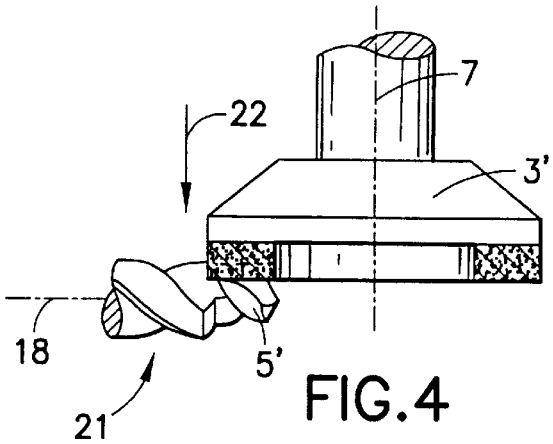
FIG. 4 shows the drill of FIG. 3 while engaged by a grinding disk in a first operating step, to form a stepped drill.
Figure 5:
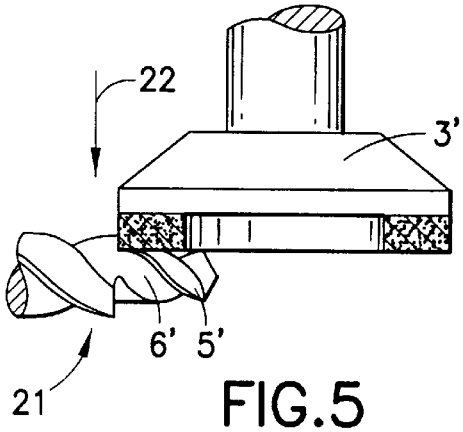
FIG. 5 shows the drill of FIGS. 3 and 4, to form a stepped diameter of the drill, in a second operating step.

Drill 21 is secured in the grinding machine 8 and affixed in the positioning system 17, where it is first subjected to coarse grinding, as illustrated in FIG. 4. The grinding head 9 has a coarse grinding disk 3' which permits substantially high material removal. The grinding disk 3' is rotated about its axis 7 and slowly moved in the direction of the feed arrow 22 against the drill 21. The grinding disk 3' engages into the material of the drill 21 more and more. The drill 21 is rotated slowly about its axis 18 when the disk 3' is in engagement with a rib 5' of the drill 21; when the disk 3' reaches a region of a recess 6', the rotation of the drill 21 about its axis 18 is rapid.

This coarse grinding operation is carried out until the drill 21, in the region of grinding, reaches approximately the desired diameter with, however, an excess dimension of, for example, 0.05 mm. At that time, the grinding disk 3' can be moved away from the drill and, in a next step—see FIG. 5—it can again be engaged with the drill 21, however axially further away from the tip of the drill 21. These coarse grinding steps can be carried out, sequentially, until the drill 21 has the desired diameter for the desired axial length. The individual ribs 5', during this coarse grinding, are more or less in continuous engagement with the grinding disk 3'. The recess 6' between the ribs 5' are rapidly passed.

Figure 2:
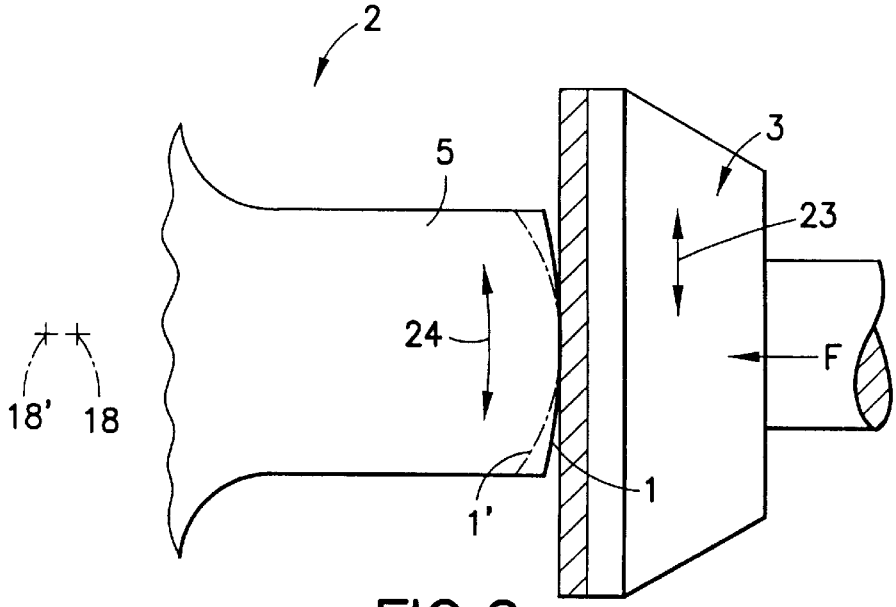
FIG. 2 is a fragmentary schematic front view, to a different scale, of the cutting tool and the grinding disk of FIG. 1.

After the coarse grinding, one or more fine precision grinding steps follow. Referring now to FIGS. 2 and 6: A grinding disk 3 is used, permitting fine precision grinding. The grinding 3 is rapidly rotated about its axis 7 and, preferably simultaneously, is oscillated in a Y-direction—see arrow 23—transverse to the cutting tool 2, in FIG. 6 the drill 21. The drill 21, further, is moved by the system 17 and subjected to a rotary oscillatory movement in the direction of the arrow 24 (FIG. 1), that is, is rocked or pivoted on the grinding disk 3. The grinding disk 3, thus, by this oscillatory movement in the direction of the arrow 24, will cover the part-cylindrical surface 1 several times. In addition, the grinding disk 3—at least in the preferred embodiment—in addition to its rotary movement and, if used, in addition to, or in lieu of, the rocking in the direction of arrow 23, carries out an oscillation parallel to the surface region 1, as illustrated by the arrow 25. The amplitude of the oscillation in the direction of the arrow 25 is smaller than the amplitude of the rocking or oscillatory movement of the cutting tool, as shown by the arrow 24. Preferably, however, the frequency of oscillation along the arrow 25 is higher than that of the frequency of oscillation about the arrow 24.

Upon grinding, the grinding disk 3 is engaged inwardly, that is, with respect to the longitudinal axis 18 of the cutting tool, radially inwardly, as shown by the force arrow F in FIG. 2, to act against the surface portion 1 of the cutting tool 2. Interruption of this force effect F during the cutting operation is effectively avoided due to the continuous engagement between the grinding disk 3 and the cutting tool 2. FIG. 2, in a highly exaggerated illustration, shows a possible shift of the longitudinal axis 18 to the point 18' due to resilient deflection of the cutting tool 2 due to force F. This deflection is effectively avoided in accordance with the present invention and, consequently, the surface portion being ground of the cutting tool 2 will receive an essentially exact part-cylindrical surface 1. In contrast thereto, a pulsating force F occurs in prior art grinding systems. Force F will be applied in pulses, due to recesses 6, 6', on the cutting tool 2 which, when it is continuously rotated throughout 360°, results in pulsing resilient deflection of the cutting tool 2. This is illustrated, highly exaggerated, in FIG. 2 by the broken-line shape 1' of the surface region 1.

The method in accordance with the present invention may be used with cutting tools 2 having straight flutes 6, as well as with cutting tools, for example drills 21, having spiral grooves 6'. In straight grooves 6, the cutting disk 3 is moved by suitable shifting and operation of the guide 15 (FIG. 7) along the axial direction of the cutting tool 2. When the cutting tool has spiral grooves 6', for example the drill 21, the drill 21 will have superimposed about the rocking or oscillatory movement a very slow rotary movement, which corresponds to the feed of the cutting head 9 on the guide 15. Feed and rotary movement can be so matched to each other that engagement with a spiral of a rib 5' of the drill is retained at all times. The control unit C can be readily programmed to carry out this rotation.

In accordance with the invention, a rotatably driven grinding disk 3 is used to grind cylindrical surface regions 1 of cutting tools 2. The cutting tool 2 is oscillated or rocked back-and-forth about its axis 18 while the grinding head 3 is in engagement with the surface region 1 to be ground. Thus, the grinding element or body 3 will cover the part-cylindrical surface region 1 several times in circumferential direction.

Various changes and modifications may be made within the scope of the inventive concept.

I claim:

1. A grinding machine for producing a chip-producing cutting tool having a longitudinal axis comprising:

a grinding head (9);

a grinding disk (3) rotatably coupled to said grinding head and having a rotational movement;

positioning means for receiving, clamping and positioning the cutting tool (2, 21) such that the longitudinal axis (18) of the cutting tool is positioned in a predetermined location, said positioning means imparting to the cutting tool (2, 21) an oscillating to-and-fro rocking movement (24) about the longitudinal axis (18) during a grinding process; and adjustment means for moving the grinding head (9) such that the grinding disk (3) engages a circumferential portion of the cutting tool (2, 21).

2. The grinding machine of claim 1, wherein said adjustment means includes an oscillatory motion driver means for imparting to said grinding disk (3) an oscillating movement with respect to said cutting tool (2, 21); and wherein said positioning means includes a control unit (C) controlling at least one of an amplitude and a frequency of said oscillating to-and-fro rocking movement of the cutting tool (2, 21).

3. The grinding machine of claim 2, wherein the control unit (C) also controls oscillatory movement of the grinding disk (3) in directions essentially perpendicular to the longitudinal axis (18) of the cutting tool (2, 21).

4. A grinding method for producing a chip-producing cutting tool having a longitudinal axis comprising:

a grinding head (9);

a grinding disk (3) rotatably coupled to said grinding head and having a rotational movement;

positioning means for receiving, clamping and positioning the cutting tool (2, 21) such that the longitudinal axis (18) of the cutting tool is positioned in a predetermined location;

adjustment apparatus (14, 15) for moving the grinding head (9) such that the grinding disk (3) engages a circumferential portion of the cutting tool (2, 21); and an oscillatory motion driver means for imparting to said grinding disk (3) an oscillating movement with respect to said cutting tool (2, 21) during a grinding process, wherein the grinding disk exhibits the oscillating movement simultaneously with the rotational movement.

5. The grinding machine of claim 4, wherein said positioning means imparts to the cutting tool an oscillating to-and-fro rocking movement (24) about the longitudinal axis of the cutting tool.

6. The grinding machine of claim 5, wherein said positioning means includes a control unit (C) controlling at least one of an amplitude and a frequency of said oscillating to-and-fro rocking movement of the cutting tool (2, 21).

7. The grinding machine of claim 6, wherein the control unit (C) controls the oscillatory movement of the grinding disk (3) in directions essentially perpendicular to the longitudinal axis (10) of the cutting tool (2, 21).

* * * * *